US010774436B2

(12) United States Patent
Sun et al.

(10) Patent No.: US 10,774,436 B2
(45) Date of Patent: Sep. 15, 2020

(54) HIGH PURITY ALUMINUM TOP COAT ON SUBSTRATE

(71) Applicant: Applied Materials, Inc., Santa Clara, CA (US)

(72) Inventors: Jennifer Y. Sun, Mountain View, CA (US); Sumanth Banda, San Jose, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 315 days.

(21) Appl. No.: 15/811,563

(22) Filed: Nov. 13, 2017

(65) Prior Publication Data

US 2018/0066373 A1 Mar. 8, 2018

Related U.S. Application Data

(62) Division of application No. 14/762,151, filed as application No. PCT/US2014/019999 on Mar. 3, 2014, now Pat. No. 9,850,591.

(60) Provisional application No. 61/783,667, filed on Mar. 14, 2013.

(51) Int. Cl.

| | |
|---|---|
| ***C25D 11/04*** | (2006.01) |
| ***C25D 5/48*** | (2006.01) |
| ***C25D 11/02*** | (2006.01) |
| ***C25D 17/00*** | (2006.01) |
| ***C25D 3/54*** | (2006.01) |

(52) U.S. Cl.

CPC ..... *C25D 11/04* (2013.01); *C25D 3/54* (2013.01); *C25D 5/48* (2013.01); *C25D 11/024* (2013.01); *C25D 17/001* (2013.01)

(58) Field of Classification Search

None

See application file for complete search history.

(56) References Cited

U.S. PATENT DOCUMENTS

| | | | |
|---|---|---|---|
| 3,151,948 | A | 10/1964 | Steeves |
| 3,969,195 | A | 7/1976 | Dotzer et al. |
| 4,430,387 | A | 2/1984 | Nakagawa et al. |
| 4,465,561 | A | 8/1984 | Nguyen et al. |
| 4,624,752 | A | 11/1986 | Arrowsmith et al. |

(Continued)

FOREIGN PATENT DOCUMENTS

| | | | |
|---|---|---|---|
| CN | 102864479 | A | 1/2013 |
| DE | 10248118 | A1 | 4/2004 |

(Continued)

OTHER PUBLICATIONS

International Search Report and Written Opinion dated Jun. 25, 2014 for PCT/US2014/019999 filed Mar. 3, 2014.

(Continued)

*Primary Examiner* — David Sample
*Assistant Examiner* — Elizabeth Collister
(74) *Attorney, Agent, or Firm* — Lowenstein Sandler LLP

(57) ABSTRACT

A chamber component for a processing chamber comprises an article having impurities, an aluminum coating on a surface of the article, wherein the aluminum coating is substantially free from impurities, and an anodization layer over the aluminum coating. The anodization layer comprises aluminum oxide. The anodization layer further comprises a dense barrier layer portion and a porous columnar layer portion.

18 Claims, 6 Drawing Sheets

(56) References Cited

U.S. PATENT DOCUMENTS

| | | | |
|---|---|---|---|
| 4,883,541 | A | 11/1989 | Tadros |
| 4,925,738 | A | 5/1990 | Tsuya et al. |
| 4,948,475 | A | 8/1990 | Doetzer et al. |
| 5,069,938 | A | 12/1991 | Lorimer et al. |
| 5,104,514 | A | 4/1992 | Quartarone |
| 5,192,610 | A | 3/1993 | Lorimer et al. |
| 5,494,713 | A | 2/1996 | Ootuki |
| 5,779,848 | A | 7/1998 | Aruga |
| 6,027,629 | A | 2/2000 | Hisamoto et al. |
| 6,444,304 | B1 | 9/2002 | Hisamoto et al. |
| 6,466,881 | B1 | 10/2002 | Shih et al. |
| 6,521,046 | B2 | 2/2003 | Tanaka et al. |
| 6,659,331 | B2 | 12/2003 | Thach et al. |
| 6,682,627 | B2 | 1/2004 | Shamouilian et al. |
| 6,686,053 | B2 | 2/2004 | Wada et al. |
| 6,776,873 | B1 | 8/2004 | Sun et al. |
| 7,005,194 | B2 | 2/2006 | Wada et al. |
| 7,033,447 | B2 | 4/2006 | Lin et al. |
| 7,048,814 | B2 | 5/2006 | Lin et al. |
| 7,055,732 | B2 | 6/2006 | Thach et al. |
| 7,732,056 | B2 | 6/2010 | Bhatnagar et al. |
| 8,067,067 | B2 | 11/2011 | Sun et al. |
| 8,124,240 | B2 | 2/2012 | Ohmi et al. |
| 8,128,750 | B2 | 3/2012 | Kenworthy et al. |
| 8,129,029 | B2 | 3/2012 | Sun et al. |
| 8,206,833 | B2 | 6/2012 | Ohmi et al. |
| 8,282,987 | B2 | 10/2012 | Kenworthy et al. |
| 8,591,986 | B1 | 11/2013 | Ajdelsztajn et al. |
| 8,999,475 | B2 | 4/2015 | Mitsuhashi |
| 9,012,030 | B2 | 4/2015 | Han et al. |
| 9,123,651 | B2 | 9/2015 | Shih et al. |
| 9,337,002 | B2 | 5/2016 | Daugherty et al. |
| 9,528,176 | B2 | 12/2016 | Mizuno et al. |
| 9,663,870 | B2 | 5/2017 | Sun et al. |
| 2003/0044714 | A1 | 3/2003 | Teraoka et al. |
| 2003/0047464 | A1 | 3/2003 | Sun et al. |
| 2003/0056897 | A1 | 3/2003 | Shamouilian et al. |
| 2004/0124280 | A1 | 7/2004 | Shih et al. |
| 2004/0126499 | A1 | 7/2004 | Heinrich et al. |
| 2004/0137299 | A1 | 7/2004 | Mazza et al. |
| 2004/0221959 | A1 | 11/2004 | Choi et al. |
| 2005/0037193 | A1 | 2/2005 | Sun et al. |
| 2006/0019035 | A1 | 1/2006 | Munz et al. |
| 2006/0024517 | A1 | 2/2006 | Doan et al. |
| 2006/0060472 | A1 | 3/2006 | Tomita et al. |
| 2006/0093736 | A1 | 5/2006 | Raybould et al. |
| 2006/0234396 | A1 | 10/2006 | Tomita et al. |
| 2007/0012657 | A1 | 1/2007 | O'Donnell et al. |
| 2008/0029032 | A1 | 2/2008 | Sun et al. |
| 2008/0223725 | A1 | 9/2008 | Han et al. |
| 2008/0241517 | A1 | 10/2008 | Kenworthy et al. |
| 2008/0283408 | A1 | 11/2008 | Nishizawa |
| 2009/0050485 | A1 | 2/2009 | Wada et al. |
| 2009/0145769 | A1 | 6/2009 | Tsuda |
| 2009/0298251 | A1 | 12/2009 | Choi et al. |
| 2010/0155251 | A1 | 6/2010 | Bogue et al. |
| 2010/0170937 | A1 | 7/2010 | Calla |
| 2011/0020665 | A1 | 1/2011 | Serafin et al. |
| 2011/0168210 | A1 | 7/2011 | Tabata et al. |
| 2011/0206833 | A1 | 8/2011 | Sexton et al. |
| 2011/0220289 | A1 | 9/2011 | Tanaka et al. |
| 2012/0103526 | A1 | 5/2012 | Ouye et al. |
| 2012/0138472 | A1 | 6/2012 | Han et al. |
| 2012/0247961 | A1 | 10/2012 | Ohmi et al. |
| 2013/0008796 | A1 | 1/2013 | Silverman et al. |
| 2014/0110145 | A1 | 4/2014 | Elie et al. |
| 2014/0120312 | A1 | 5/2014 | He et al. |
| 2014/0272459 | A1 | 9/2014 | Daugherty et al. |
| 2014/0315392 | A1 | 10/2014 | Xu et al. |
| 2015/0064450 | A1 | 3/2015 | Sun et al. |
| 2015/0203981 | A1 | 7/2015 | Mitsuhashi |
| 2015/0337450 | A1 | 11/2015 | Shih et al. |
| 2015/0376810 | A1 | 12/2015 | Browning et al. |
| 2016/0002811 | A1 | 1/2016 | Sun et al. |

FOREIGN PATENT DOCUMENTS

| | | | | |
|---|---|---|---|---|
| EP | 0792951 | B1 * | 9/2001 | ..... C25D 11/045 |
| JP | H05129467 | A | 5/1993 | |
| JP | 2009-099853 | A | 5/2009 | |
| KR | 100607790 | | 8/2006 | |
| KR | 10-2006-0111201 | A | 10/2006 | |
| KR | 10-2007-0001722 | A | 1/2007 | |
| KR | 10-2012-0077375 | A | 7/2012 | |
| WO | 2009031841 | | 12/2009 | |

OTHER PUBLICATIONS

Ohgai et al., "Template Synthesis and Magnetoresistance Property of Ni and Co Single Nanowires Electrodeposited into nanopores with a Wide Range of Aspect Ratios," J. Phys. D: Appl. Phys., Nov. 25, 2003, vol. 36, pp. 3109-3114.

Tan et al., "High Aspect Ratio Microstructures on Porous Anodic Aluminum Oxide," IEEE, Jan. 1995, pp. 267-272.

Paredes et al., "The Effect of Roughness and Pre-Heating of the Substrate on the Morphology of Aluminum Coatings Deposited by Thermal Spraying," Surface & Coatings Technology, Sep. 8, 2005, vol. 200, pp. 3049-3055.

* cited by examiner

HIGH PURITY ALUMINUM TOP COAT ON SUBSTRATE

RELATED APPLICATIONS

This application is a divisional of U.S. patent application Ser. No. 14/762,151, filed Jul. 20, 2015, which is a U.S. National Stage Application under 35 U.S.C. § 371 of International PCT Application No. PCT/US2014/019999, filed Mar. 4, 2014, which claims priority to U.S. Provisional Application No. 61/783,667, filed Mar. 14, 2013, all of which are hereby incorporated by reference herein.

TECHNICAL FIELD

Embodiments of the present disclosure relate, in general, to aluminum coated articles and to a process for applying an aluminum coating to a substrate.

BACKGROUND

In the semiconductor industry, devices are fabricated by a number of manufacturing processes producing structures of an ever-decreasing size. Some manufacturing processes may generate particles, which frequently contaminate the substrate that is being processed, contributing to device defects. As device geometries shrink, susceptibility to defects increases, and particle contaminant requirements become more stringent. Accordingly, as device geometries shrink, allowable levels of particle contamination may be reduced.

SUMMARY

In one embodiment, an aluminum coating is formed on an article, and the aluminum coating is anodized to form an anodization layer. The anodization layer can have a thickness in a range between 40% to 60% of the thickness of the aluminum coating. The anodization layer can also have a thickness up to 2 to 3 times the thickness of the aluminum coating.

In one embodiment, the aluminum is a high purity aluminum. The aluminum coating may have a thickness in a range from about 0.8 mils to about 4 mils. The anodization layer may have a thickness in a range from about 0.4 to about 4 microns. In one embodiment, a surface roughness of the anodization layer is about 40 micro-inch.

In one embodiment, the article can include at least one of aluminum, copper, magnesium, an aluminum alloy (e.g., Al6061), or a ceramic material.

In one embodiment, the aluminum coating is formed by electroplating. About half of the anodization layer can be formed from conversion of the aluminum coating during anodization.

BRIEF DESCRIPTION OF THE DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EMBODIMENTS

Embodiments of the disclosure are directed to a process for coating an article (e.g., for use in semiconductor manufacturing) with an aluminum coating, and to an article created using such a coating process. In one embodiment, the article is coated, and then at least a portion of the coating is anodized. For example, the article may be a showerhead, a cathode sleeve, a sleeve liner door, a cathode base, a chamber liner, an electrostatic chuck base, etc. of a chamber for processing equipment such as an etcher, a cleaner, a furnace, and so forth. In one embodiment, the chamber is for a plasma etcher or plasma cleaner. In one embodiment, these articles can be formed of an aluminum alloy (e.g., Al 6061), another alloy, a metal, a metal oxide, a ceramic, or any other suitable material. The article may be a conductive article (e.g., an aluminum alloy) or a non-conductive or insulating article (e.g., a ceramic).

Parameters for the anodization may be optimized to reduce particle contamination from the article. Performance properties of the aluminum coated article may include a relatively long lifespan, and a low on-wafer particle and metal contamination.

Embodiments described herein with reference to aluminum coated conductive articles may cause reduced particle contamination and on wafer metal contamination when used in a process chamber for plasma rich processes. However, it should be understood that the aluminum coated articles discussed herein may also provide reduced particle contamination when used in process chambers for other processes such as non-plasma etchers, non-plasma cleaners, chemical vapor deposition (CVD) chamber, physical vapor deposition (PVD) chamber, and so forth.

When the terms "about" and "approximately" are used herein, these are intended to mean that the nominal value presented is precise within ±10%. The articles described herein may be other structures that are exposed to plasma.

Figure 1:
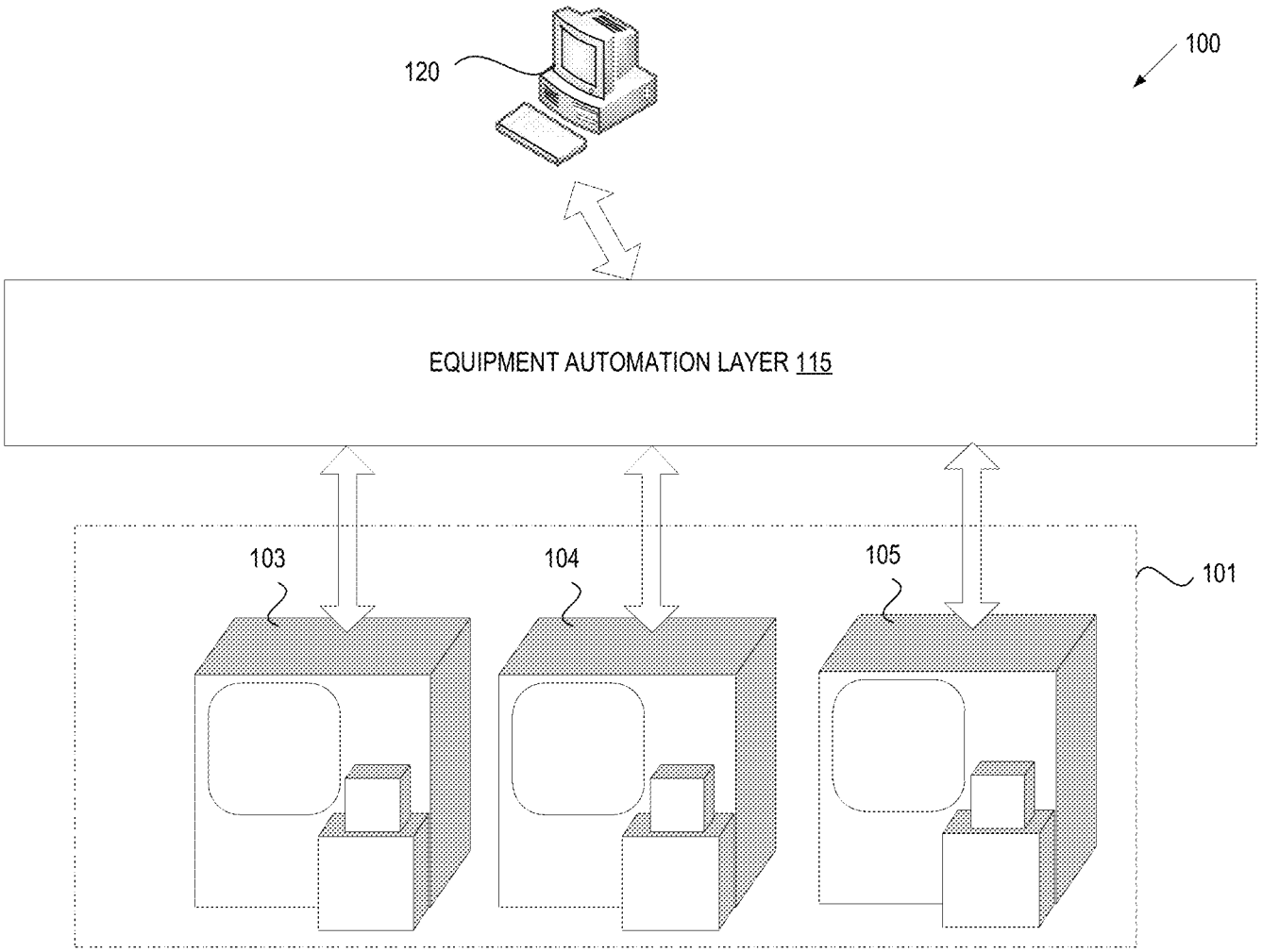
FIG. 1 illustrates an exemplary architecture of a manufacturing system, in accordance with one embodiment of the present invention.

FIG. 1 illustrates an exemplary architecture of a manufacturing system 100. The manufacturing system 100 may be a system for manufacturing an article for use in semiconductor manufacturing. In one embodiment, the manufacturing system 100 includes processing equipment 101 connected to an equipment automation layer 115. The processing equipment 101 may include one or more wet cleaners 103, an aluminum coater 104 and/or an anodizer 105. The manufacturing system 100 may further include one or more computing device 120 connected to the equipment automation layer 115. In alternative embodiments, the manufacturing system 100 may include more or fewer components. For example, the manufacturing system 100 may include manually operated (e.g., off-line) processing equipment 101 without the equipment automation layer 115 or the computing device 120.

Wet cleaners 103 are cleaning apparatuses that clean articles (e.g., conductive articles) using a wet clean process. Wet cleaners 103 include wet baths filled with liquids, in which the substrate is immersed to clean the substrate. Wet cleaners 103 may agitate the wet bath using ultrasonic waves during cleaning to improve a cleaning efficacy. This is referred to herein as sonicating the wet bath.

In one embodiment, wet cleaners 103 include a first wet cleaner that cleans the articles using a bath of de-ionized (DI) water and a second wet cleaner that cleans the articles using a bath of acetone. Both wet cleaners 103 may sonicate the baths during cleaning processes. The wet cleaners 103 may clean the article at multiple stages during processing. For example, wet cleaners 103 may clean an article after a substrate has been roughened, after an aluminum coating has been applied to the substrate, after the article has been used in processing, and so forth.

In other embodiments, alternative types of cleaners such as dry cleaners may be used to clean the articles. Dry cleaners may clean articles by applying heat, by applying gas, by applying plasma, and so forth.

Aluminum coater 104 is a system configured to apply an aluminum coating to the surface of the article. In one embodiment, aluminum coater 104 is an electroplating system that plates the aluminum on the article (e.g., a conductive article) by applying an electrical current to the article when the article is immersed in an electroplating bath including aluminum, which will be described in more detail below. Here, surfaces of the article can be coated evenly because the conductive article is immersed in the bath. In alternative embodiments, the aluminum coater 104 may use other techniques to apply the aluminum coating such as physical vapor deposition (PVD), chemical vapor deposition (CVD), twin wire arc spray, ion vapor deposition, sputtering, and cold spray.

In one embodiment, anodizer 105 is a system configured to form an anodization layer on the aluminum coating. For example, the article (e.g., a conductive article) is immersed in an anodization bath, e.g., including sulfuric acid or oxalic acid, and an electrical current is applied to the article such that the article is an anode. The anodization layer then forms on the aluminum coating on the article, which will be discussed in more detail below.

The equipment automation layer 115 may interconnect some or all of the manufacturing machines 101 with computing devices 120, with other manufacturing machines, with metrology tools and/or other devices. The equipment automation layer 115 may include a network (e.g., a location area network (LAN)), routers, gateways, servers, data stores, and so on. Manufacturing machines 101 may connect to the equipment automation layer 115 via a SEMI Equipment Communications Standard/Generic Equipment Model (SECS/GEM) interface, via an Ethernet interface, and/or via other interfaces. In one embodiment, the equipment automation layer 115 enables process data (e.g., data collected by manufacturing machines 101 during a process run) to be stored in a data store (not shown). In an alternative embodiment, the computing device 120 connects directly to one or more of the manufacturing machines 101.

In one embodiment, some or all manufacturing machines 101 include a programmable controller that can load, store and execute process recipes. The programmable controller may control temperature settings, gas and/or vacuum settings, time settings, etc. of manufacturing machines 101. The programmable controller may include a main memory (e.g., read-only memory (ROM), flash memory, dynamic random access memory (DRAM), static random access memory (SRAM), etc.), and/or a secondary memory (e.g., a data storage device such as a disk drive). The main memory and/or secondary memory may store instructions for performing heat treatment processes described herein.

The programmable controller may also include a processing device coupled to the main memory and/or secondary memory (e.g., via a bus) to execute the instructions. The processing device may be a general-purpose processing device such as a microprocessor, central processing unit, or the like. The processing device may also be a special-purpose processing device such as an application specific integrated circuit (ASIC), a field programmable gate array (FPGA), a digital signal processor (DSP), network processor, or the like. In one embodiment, programmable controller is a programmable logic controller (PLC).

Figure 2:
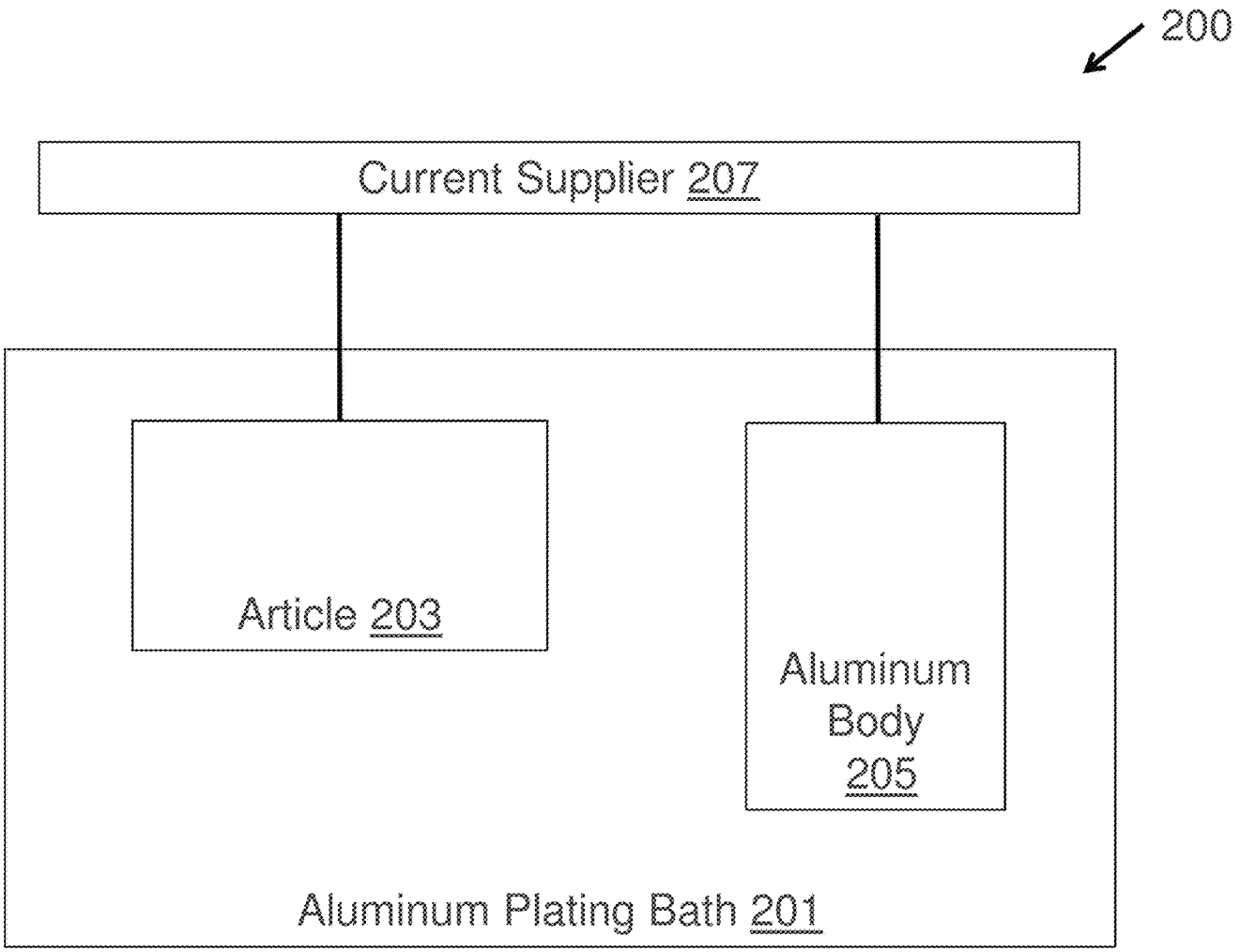
FIG. 2 illustrates a process for electroplating a conductive article with aluminum, in accordance with one embodiment of the present invention.

FIG. 2 illustrates a process for electroplating an article (e.g., a conductive article) with aluminum, in accordance with one embodiment of the present invention. Electroplating may produce an aluminum layer having a purity of 99.99. Electroplating is a process that uses electrical current to reduce dissolved metal cations to form a metal coating on an electrode, e.g., article 203. The article 203 is the cathode, and an aluminum body 205 (e.g., high purity aluminum) is the anode. Both components are immersed in an aluminum plating bath 201 including an electrolyte solution containing one or more dissolved metal salts as well as other ions that permit the flow of electricity. A current supplier 207 (e.g., a battery or other power supply) supplies a direct current to the article 203, oxidizing the metal atoms of the aluminum body 205 such that the metal atoms dissolve in the solution. The dissolved metal ions in the electrolyte solution are reduced at the interface between the solution and the article 203 to plate onto the article 203 and form an aluminum plating layer. The aluminum plating is typically smooth. For example, the aluminum plating may have a surface roughness (Ra) of about 20 micro-inch to about 200 micro-inch.

In one embodiment, the aluminum plating layer thickness is optimized for both cost savings and adequate thickness for anodization. Half of thickness of the anodization layer may be based on consumption of the thickness of the aluminum plating layer. In one embodiment, the anodization layer consumes all of the aluminum layer. Thus, the thickness of the aluminum layer may be half of the target thickness of the anodization layer. In another embodiment, the aluminum plating layer may be formed to have a thickness that is twice that of the desired thickness of the anodization layer. Other thicknesses of the aluminum plating layer may also be used. In one embodiment, the aluminum plating layer has a thickness of 5 mils. In one embodiment, the aluminum plating layer has a thickness in a range from about 0.8 mils to about 4 mils. Note that other aluminum coating processes other than electroplating may also be used in other embodiments.

Figure 3:
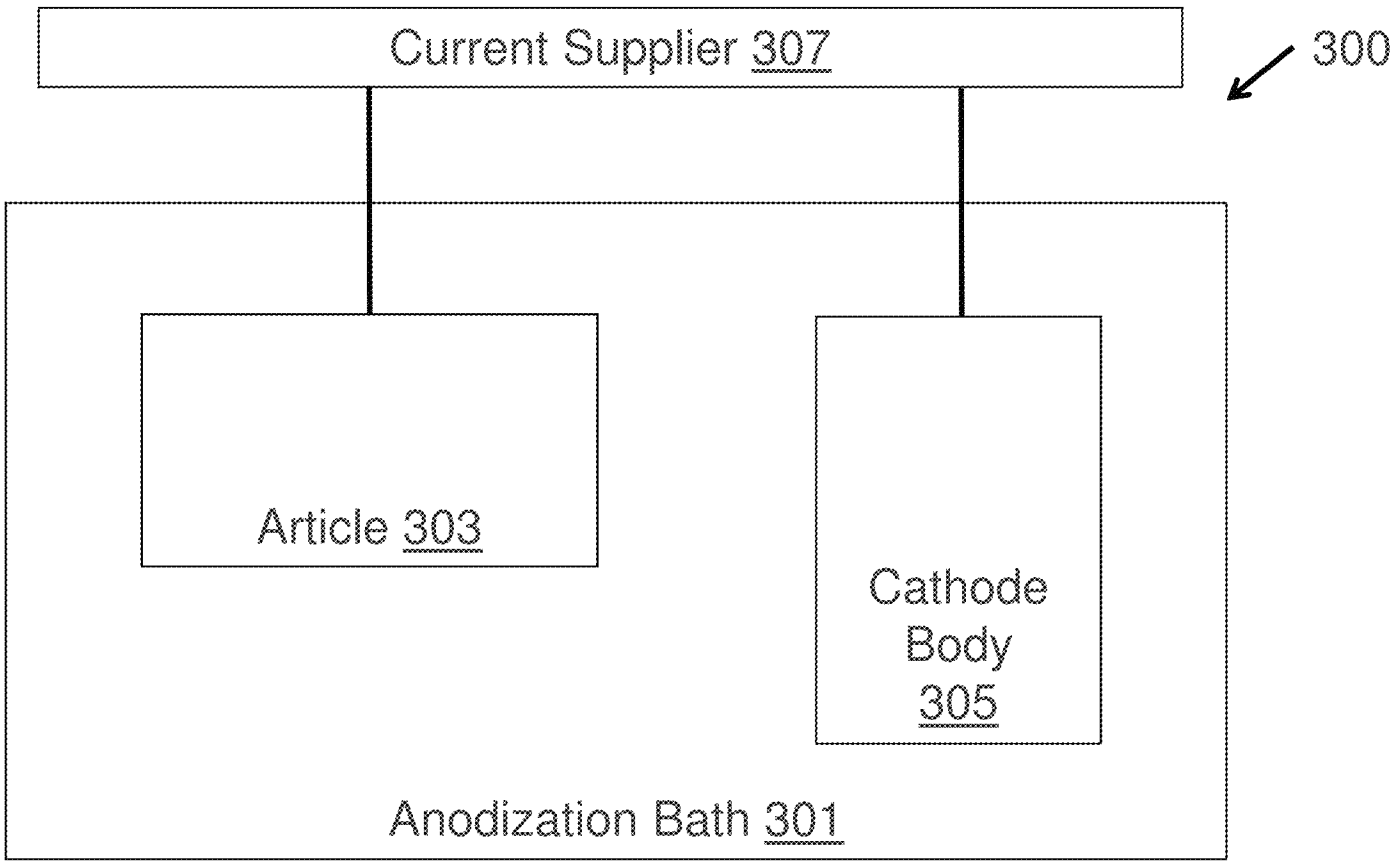
FIG. 3 illustrates a process for anodizing an aluminum coated conductive article, in accordance with one embodiment of the present invention.

FIG. 3 illustrates a process for anodizing an aluminum coated article 303, according to one embodiment. Note that in some embodiments anodization is not performed. For example, the article 303 can be the article 203 of FIG. 2. Anodization changes the microscopic texture of the surface of the article 303. Preceding the anodization process, the article 303 can be cleaned in a nitric acid bath or brightened in a mix of acids, i.e., be subjected to a chemical treatment (e.g., deoxidation) prior to anodization.

The article 303 is immersed in an anodization bath 301, including an acid solution, along with a cathode body 305. Examples of cathode bodies that may be used include aluminum alloys such as Al6061 and Al3003 and carbon bodies. The anodization layer is grown on the article 303 by passing a current through an electrolytic solution via a current supplier 307 (e.g., a battery or other power supply), where the article is the anode (the positive electrode). The current releases hydrogen at the cathode body, e.g., the negative electrode, and oxygen at the surface of the article 303 to form aluminum oxide. In one embodiment, the voltage that enables anodization using various solutions may range from 1 to 300 V, in one embodiment, or from 15 to 21 V, in another embodiment. The anodizing current varies with the area of the aluminum body 305 anodized, and can range from 30 to 300 amperes/meter$^2$ (2.8 to 28 ampere/ft$^2$).

The acid solution dissolves (i.e., consumes or converts) a surface of the article (e.g., the aluminum coating) to form a coating of columnar nanopores, and the anodization layer continues growing from this coating of nanopores. The columnar nanopores may be 10 to 150 nm in diameter. The acid solution can be oxalic acid, sulfuric acid, or a combination of oxalic acid and sulfuric acid. For oxalic acid, the ratio of consumption of the article to anodization layer growth is about 1:1. For sulfuric acid, the ratio of consumption of the article to anodization layer growth is about 2:1. Electrolyte concentration, acidity, solution temperature, and current are controlled to form a consistent aluminum oxide anodization layer. In one embodiment, the anodization layer can have a thickness of up to 4 mils. In one embodiment, the anodization layer has a minimum thickness of 0.4 mils. In one embodiment, the anodization layer has a thickness in a range between 40% to 60% of the thickness of the aluminum coating. In one embodiment, the anodization layer has a thickness in a range between 30% to 70% of the thickness of the aluminum coating, though the anodization layer can have thicknesses that are other percentages of the aluminum coating. In one embodiment, all of the aluminum layer is anodized. Accordingly, the anodization layer may have a thickness that is twice the thickness of the aluminum coating (for anodization performed using oxalic acid) or that is approximately 1.5 times the thickness of the aluminum coating (for anodization performed using sulfuric acid).

In one example, if oxalic acid is used to perform the anodization, the aluminum coating is initially 4 mils thick, the resulting anodization layer may be 4 mils thick, and a resulting aluminum coating after the anodization may be 2 mils thick. In another example, if sulfuric acid is used to perform the anodization, the aluminum coating is initially 4 mils thick, the resulting anodization layer may be 3 mils thick, and a resulting aluminum coating after the anodization may be 2 mils thick. In one embodiment, a thicker aluminum coating is used if sulfuric acid is to be used for the anodization.

In one embodiment, the current density is initially high to grow a very dense barrier layer portion of the anodization layer, and then current density is reduced to grow a porous columnar layer portion of the anodization layer. In one embodiment where oxalic acid is used to form the anodization layer, the porosity is in a range from about 40% to about 50%, and the pores have a diameter in a range from about 20 nm to about 30 nm. In one embodiment where sulfuric acid is used to form the anodization layer, the porosity can be up to about 70%.

In one embodiment, the surface roughness (Ra) of the anodization layer is about 40 micro-inch, which is similar to the roughness of the article. In one embodiment, the surface roughness increases 20-30% after anodizing with sulfuric acid.

In one embodiment, the aluminum coating is about 100% anodized. In one embodiment, the aluminum coating is not anodized.

Table A shows the results of laser ablation inductively coupled plasma mass spectrometry (ICPMS) used to detect metallic impurities in an Al6061 article, an anodized Al6061 article, an aluminum coating including an aluminum plating layer on an Al6061 article, and an anodized aluminum coating including an aluminum plating layer on an Al6061 article. In this example, the aluminum plating layer is applied via electroplating, and the anodization occurs in an oxalic acid bath. The anodized aluminum plating layer on the Al6061 article shows the lowest levels of impurities.

TABLE A

| Parameter | RL (detection limit of test) | Units | Al 6061 | Anodized Al 6061 | Al Plating on Al6061 | Anodized Al Plating on Al6061 |
|---|---|---|---|---|---|---|
| Chromium | 0.02 | ppm (μg/g) | 850 | 1600 | 1.7 | |
| Copper | 0.02 | ppm (μg/g) | 2500 | 2800 | 12 | 4 |
| Iron | 0.05 | ppm (μg/g) | 1300 | 2700 | 140 | 26 |
| Magnesium | 0.01 | ppm (μg/g) | 4200 | 9700 | 3.6 | 1.5 |
| Manganese | 0.01 | ppm (μg/g) | 210 | 540 | 2.9 | 3.6 |
| Nickel | 0.01 | ppm (μg/g) | 37 | 120 | 12 | 3 |
| Titanium | 0.01 | ppm (μg/g) | 190 | 160 | | 1.2 |
| Zinc | 0.04 | ppm (μg/g) | 1000 | 1600 | 4.8 | |

Figure 4:
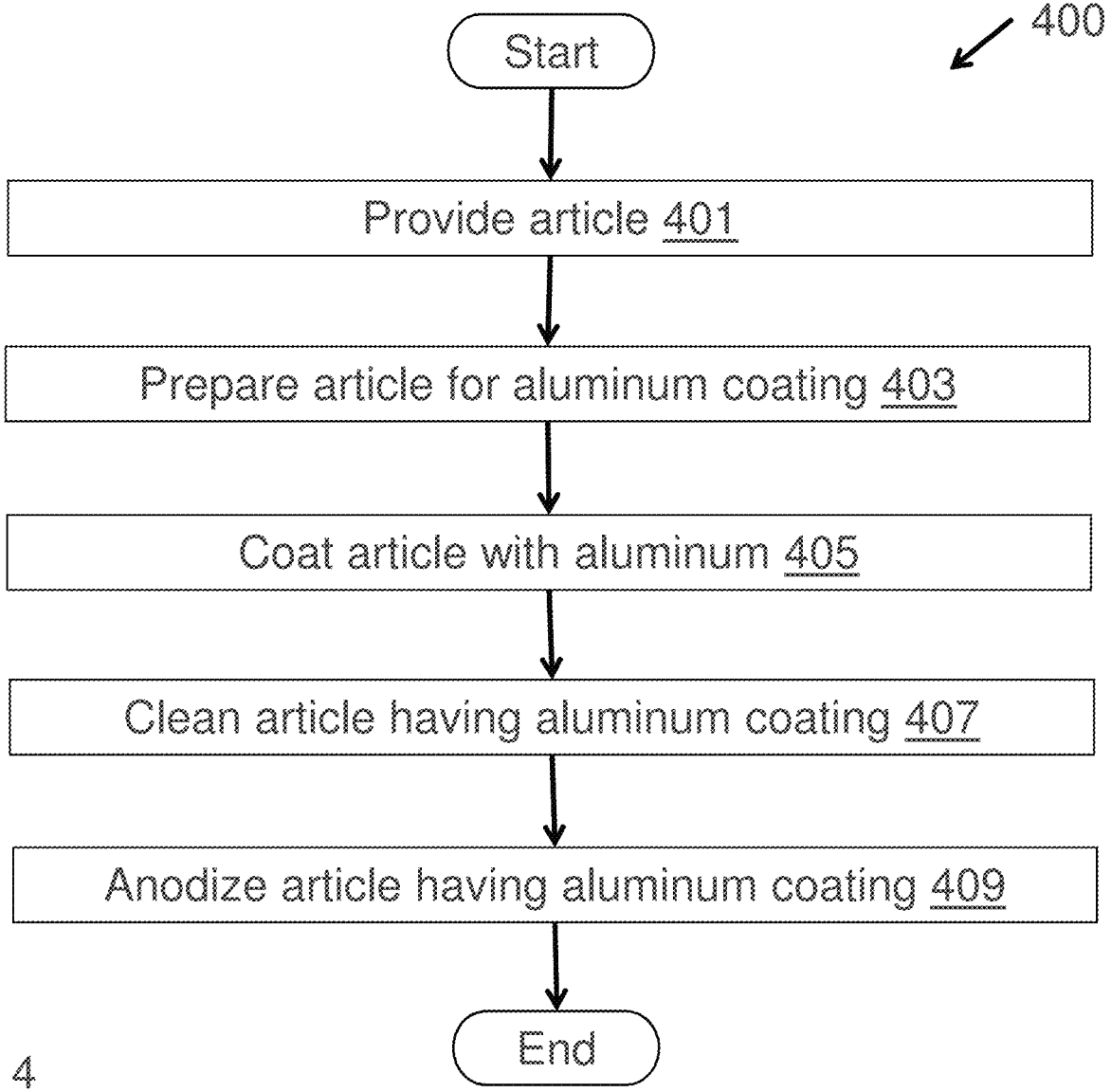
FIG. 4 illustrates a process for manufacturing an aluminum coated conductive article, in accordance with one embodiment of the present invention.

FIG. 4 is a flow chart showing a method 400 for manufacturing an aluminum coated article, in accordance with embodiments of the present disclosure. The operations of process 400 may be performed by various manufacturing machines, as set forth in FIG. 1. The process 400 may be applied to coat aluminum any article.

At block 401, an article (e.g., an article having at least a conductive portion) is provided. For example, the article can be a conductive article formed of an aluminum alloy (e.g., Al 6061), another alloy, a metal, a metal oxide, or a ceramic. The article can be a shower head, a cathode sleeve, a sleeve liner door, a cathode base, a chamber liner, an electrostatic chuck base, etc., for use in a processing chamber.

At block 403, the article is prepared for coating, according to one embodiment. The surface of the article may be altered by roughening, smoothing, or cleaning the surface.

At block 405, the article is coated (e.g., plated) with aluminum. For example, the article can be electroplated with aluminum, as similarly described with respect to FIG. 2. In other examples, the coating can be applied by physical vapor deposition (PVD), chemical vapor deposition (CVD), twin wire arc spray, ion vapor deposition, sputtering, and cold spray.

At block 407, the article with the aluminum coating is cleaned, according to one embodiment. For example, the article can be cleaned by immersing the article in nitric acid to remove surface oxidation.

At block 409, the article with the aluminum coating is anodized, according to one embodiment. For example, the article can be anodized in a bath of oxalic acid or sulfuric acid, as similarly described with respect to FIG. 3.

Figure 5:
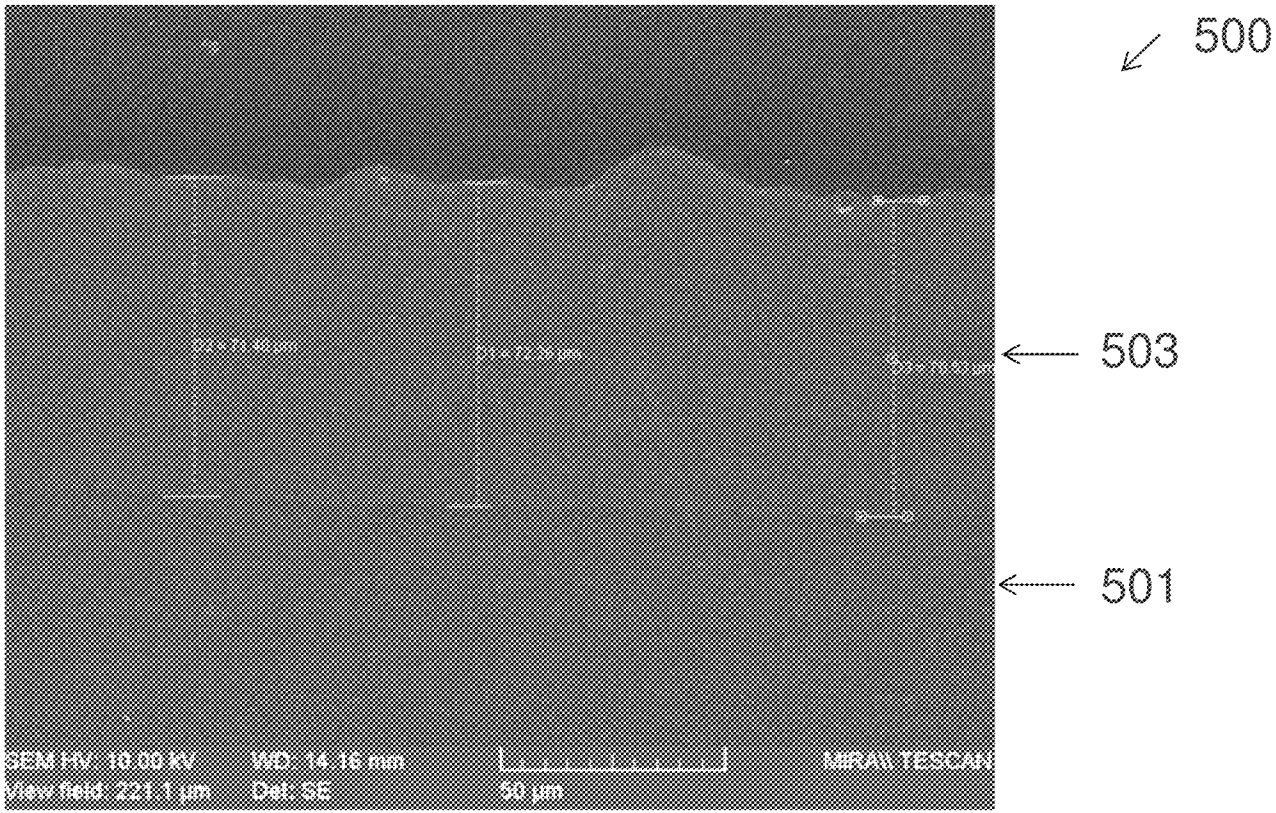
FIG. 5 illustrates a cross-sectional view of one embodiment of an aluminum coating on a conductive article.

FIG. 5 illustrates a scanning electron micrograph 500 of a cross-sectional view of an Al6061 article 501 with an aluminum coating 503, applied via electroplating at approximately 1000-fold magnification with a 50 micron scale shown. The thickness of the aluminum plating layer is about 70 microns.

Figure 6:
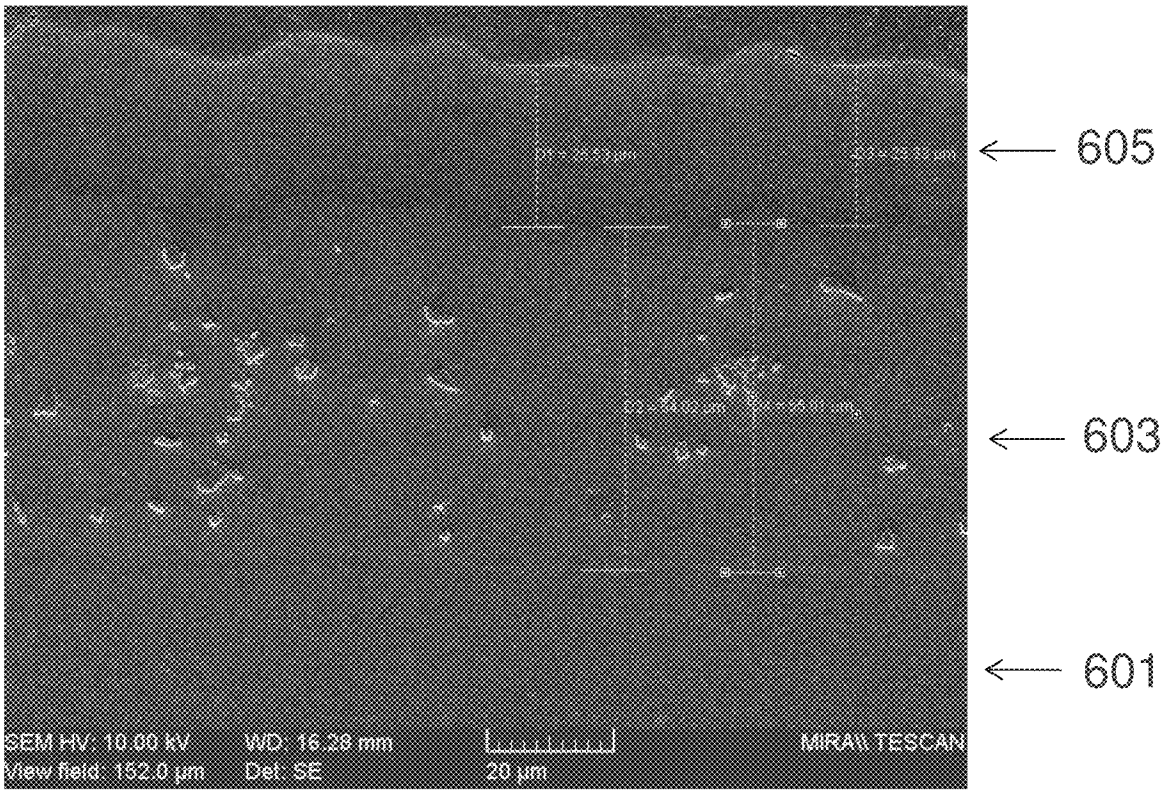
FIG. 6 illustrates a cross-sectional view of one embodiment of an aluminum coating and an anodization layer on a conductive article.

FIG. 6 illustrates a scanning electron micrograph 600 of a cross-sectional view of an Al6061 article 601 with an aluminum coating 603, applied via electroplating, and an anodization layer 605, formed in an oxalic acid bath, at about 800-fold magnification with a 20 micron scale shown. The thickness of the aluminum plating layer is about 55 microns, and the thickness of the anodization layer is about 25 microns.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A chamber component for a processing chamber, comprising:
- a body that comprises impurities;
- an aluminum coating on a surface of the body, wherein the aluminum coating is substantially free from impurities; and
- an anodization layer over the aluminum coating, wherein the anodization layer comprises $Al_2O_3$, and wherein the anodization layer further comprises:
  - a dense barrier layer portion; and
  - a porous columnar layer portion, wherein the porous columnar layer portion of the anodization layer has a porosity of about 40% to 50% and comprises a plurality of columnar nanopores, wherein the plurality of columnar nanopores have a diameter of 10 nm to 150 nm, and wherein a surface roughness of the anodization layer is about 40 micro-inch.

2. The chamber component of claim 1, wherein the chamber component is a chamber component of a processing chamber that performs plasma processes.

3. The chamber component of claim 1, wherein the aluminum coating has a thickness in a range of about 0.8 mils to about 5 mils.

4. The chamber component of claim 1, wherein the anodization layer has a thickness of about 2-4 mils.

5. The chamber component of claim 1, wherein the anodization layer has a thickness in a range from about 0.4 mils to about 4 mils.

6. The chamber component of claim 1, wherein a thickness of the anodization layer is 2-3 times a thickness of the aluminum coating.

7. The chamber component of claim 1, wherein the anodization layer has a thickness in a range from about 30% to less than 50% of the thickness of the aluminum coating.

8. The chamber component of claim 1, wherein the anodization layer has a thickness in a range from about 40% to 60% of the thickness of the aluminum coating.

9. The chamber component of claim 1, wherein the body comprises an alloy of at least one of copper or magnesium.

10. The chamber component of claim 1, wherein the body comprises aluminum alloy, Al 6061.

11. The chamber component of claim 1, wherein the body comprises a ceramic material.

12. The chamber component of claim 1, wherein the body comprises a metal oxide.

13. The chamber component of claim 1, wherein the anodization layer consists essentially of $Al_2O_3$.

14. The chamber component of claim 13, wherein the anodization layer comprises at least one of:
- copper impurities at a concentration of approximately 4 parts per million (ppm);
- iron impurities at a concentration of approximately 26 ppm;
- magnesium impurities at a concentration of approximately 1.5 ppm;
- manganese impurities at a concentration of approximately 3.6 ppm;
- nickel impurities at a concentration of approximately 3 ppm;
- titanium impurities at a concentration of approximately 1.2 ppm;
- chromium impurities at a concentration of approximately 0 ppm; and
- zinc impurities at a concentration of approximately 0 ppm.

15. The chamber component of claim 1, wherein the chamber component is selected from a group consisting of a showerhead, a cathode sleeve, a sleeve liner door, a cathode base, a chamber liner, and an electrostatic chuck base.

16. The chamber component of claim 1, wherein the plurality of columnar nanopores have a diameter of about 20-30 nm.

17. A chamber component for a processing chamber, comprising:
- a body that comprises impurities;
- an aluminum coating on a surface of the body, wherein the aluminum coating is substantially free from impurities; and an anodization layer over the aluminum coating, wherein the anodization layer comprises $Al_2O_3$, and wherein the anodization layer further comprises:

a dense barrier layer portion; and a porous columnar layer portion, wherein the porous columnar layer portion of the anodization layer has a porosity of about 40% to 70% and comprises a plurality of columnar nanopores, wherein the plurality of columnar nanopores have a diameter of 10 nm to 150 nm, and wherein a surface roughness of the anodization layer is about 40 micro-inch.

18. The chamber component of claim 17, wherein the anodization layer has a thickness of about 2-4 mils and the aluminum coating has a thickness in a range of about 0.8 mils to about 4 mils.

* * * * *